US005580310A

United States Patent [19]

Orus et al.

[11] Patent Number: 5,580,310

[45] Date of Patent: Dec. 3, 1996

[54] GAMES MACHINE WITH MECHANICAL COUNTERS AS LAID DOWN BY REGULATIONS, AND WITH ELECTRONIC PAYMENT MECHANISM

[75] Inventors: Hervé Orus, Marseille; Alain Nicolai, Allauch; Jean-Jacques Foglino, Peynier, all of France

[73] Assignee: Gemplus Card International

[21] Appl. No.: 404,249

[22] Filed: Mar. 15, 1995

[30] Foreign Application Priority Data

Mar. 16, 1994 [FR] France ..... 94 03098

[51] Int. Cl.[6] ..... G07F 17/34

[52] U.S. Cl. ..... 463/16; 463/25; 377/4; 377/5

[58] Field of Search ..... 273/138 A, 143 R, 273/85 CP; 463/25, 20, 16–19, 21–24, 26–28; 377/4, 5

[56] References Cited

U.S. PATENT DOCUMENTS 4,889,339 12/1989 Okada ..... 273/143 R
4,991,848 2/1991 Greenwood et al. ..... 273/143 R
5,178,390 1/1993 Okada ..... 273/143 R
5,257,179 10/1993 DeMar ..... 273/143 R

FOREIGN PATENT DOCUMENTS 0360613 3/1990 European Pat. Off. .

*Primary Examiner*—Benjamin H. Layno
*Attorney, Agent, or Firm*—Nilles & Nilles, S.C.

[57] ABSTRACT

Gaming machines provided with mechanical counters according to the regulations, to which there is grafted an electronic payment mechanism working on the basis of a chip card. It consists in diverting a certain number of links of the units of the machine by the electronic payment mechanism to enable wagers to be placed and payments to be made through the chip card, without the receiving or issuing of tokens and, preferably, without the modifying of the contents of the TOTAL IN and TOTAL OUT counters. A downgraded version modifies the contents of these counters and the balance of the feeder box containing the coins is obtained by modifying the formula used to compute this balance. It enables the efficiency of gaming machines to be raised.

20 Claims, 4 Drawing Sheets

GAMES MACHINE WITH MECHANICAL COUNTERS AS LAID DOWN BY REGULATIONS, AND WITH ELECTRONIC PAYMENT MECHANISM

BACKGROUND OF THE INVENTION

1. Field of the Invention

The present invention relates to games machines that are provided with the mechanical counters required by regulations under the law and that furthermore comprise an electronic payment mechanism making it possible to play with electronic payment means such as a chip card or smart card. Such machines enable the use of modern payment means with the advantages of speed and security related thereto while at the same time remaining in conformity with the legislation on gaming machines which is particularly stringent and enforced by inspection.

The present invention can be applied to games machines using token-operated payment mechanisms and/or electronic payment mechanisms.

2. Description of the Prior Art

It is the common practice, especially in casinos that have permission for this, to use games machines called gaming machines that enable possible winnings, which may be huge, to be made by placing wagers with coins and by setting off the machine through action on a lever that activates a randomly operating selection mechanism.

The use of cash is not practical as it necessitates the handling of large volumes of coins for relatively small sums, tends to develop the use of counterfeit money, facilitates the theft of these coins, and above all slows down the speed with which players may stake their money and hence reduces the volume of profit obtained by the owner of the machine.

To overcome these drawbacks, the present Applicant, in a European patent application No. 93 402560.2 filed on 18 Oct., 1993 under the title Machine de jeux à monnayeur electronique ("Games Machine With Electronic Payment Mechanism"), has described and claimed a device enabling the adaption to an ordinary gaming machine firstly of a payment mechanism working with secured electronic tokens that enable the replacement of the coins and, secondly, an electronic payment mechanism using a chip card of the type commonly used in telephone booths or bank cash dispensers. The machines thus equipped have a combined mode of operation since they can work with either tokens or chip cards. Such a device works well but has the drawback, if used as such, of disturbing the operation of a number of mechanical counters used, by virtue of the regulations, in the machine, thus making it contravene legislation in force in France and in some other countries.

Indeed, the possibilities of fraudulent behavior, to the detriment of both the player and the tax collector, which were widely availed of in the past by the criminal organizations that controlled this form of business, have led legislators in most countries to require the presence and use in these machines of a number of mechanical counters which, in principle, are impossible to defraud and totalize a large number of the parameters used during the working of the machine. Any attempt to falsify the operation of these counters is of course strictly prohibited.

These counters are called:

"TOTAL IN" (TI): counter of total inputs, totalizes the tokens that are physically put into the machine and, in certain machines, the credits staked;

"TOTAL OUT" (TO): counter of total outputs, totalizes the tokens that are physically put out of the machine and, in certain machines, the credits staked;

"CASH BOX" (CB): counter of receipts, totalizes the tokens sent to the receipts recording cash box or till;

"JACKPOT" (JK): counter of winnings, totalizes the so-called "jackpot" winnings which are paid by hand in the form of payment vouchers (BP);

"CANCEL CREDIT" (CC): totalizes the payments in the form of payment vouchers (BP), the totals of small winnings that exceed the limit of payment by the gaming machine;

"GAME PLAYED" (GP): counter of games, totalizes the number of games played.

It must be noted that, in France, the "CANCEL CREDIT" and "JACKPOT" counters are merged to form a single "JACKPOT" counter. This entails a number of additional difficulties for the use of a card-validation system as shall be shown hereinafter in this document.

These counters are incremented during the working of the gaming machine as described hereinafter. The movement of the coins in the machine is described schematically in FIG. 1.

When the operation of the gaming machine is started, the operator fills its feeder box 106 with a sufficient number of tokens enabling it to pay out winnings properly to customers for the day. For entry into the accounting system, these tokens are taken out of the accounts and their input into the feeder box is registered in the form of an advance voucher (AV) 105.

When a player makes the machine work by putting a coin into the payment mechanism, the TOTAL IN (TI) counter 101 is incremented by one unit. The coin thus inserted then goes by one of the following paths, under the control of the deflector 102:

if the feeder box is full, the token falls into the receipts till and the CASH BOX (CB) counter is incremented by one unit;

if the feeder box is not full, the token falls into it and increases the mass of tokens that may be redistributed to the customer in the event of winnings.

The player may, however, may make wagers with sums contained in a counter 103 called "CREDIT" when it is not at zero. This counter, which is not included among the mechanical counters, enables the winnings to be totalized so that they are not distributed immediately. (For this purpose, the parameters will have been entered into the machine, this operation being known to those skilled in the art).

In certain types of machines, when the player thus stakes a CREDIT token, the TOTAL IN (TI) counter is incremented by one unit to account for the entry of this virtual token, and the TOTAL OUT (TO) counter is also incremented by one unit to re-establish the account of the real tokens that have physically entered the machine. In any case, the fact of adding credits does not affect the TOTAL IN and TOTAL OUT counters. This is necessary to keep the exact account of the tokens physically present in the feeder box.

The wager having thus been placed, when the customer starts a game, the GAME PLAYED (GP) counter is incremented by one unit.

If the game is lost, nothing happens.

If the game is won, and brings in variable winnings for the player, then the CREDIT counter is incremented by the number of units corresponding to the winnings obtained, of course if the machine should be configured in credit mode. Otherwise the tokens fall into the feeder box.

The player having thus won may decide to continue to play. He or she then starts the game again on the basis of the contents of the CREDIT counter which is decremented, and so on and so forth.

When the player decides to take his winnings, he presses a button called the CASH OUT BUTTON and the machine then pays out the winnings in two possible ways, depending on the amount of these winnings:

if the total of the winnings does not exceed the limit allowed for automatic distribution, which depends essentially on the capacity of the feeder box and the parameters set for the gaming machine, the tokens involved fall from said feeder box into a receptacle from which the player can recover them. During this operation, the TOTAL OUT (TO) counter is incremented by the number of tokens paid out;

if the total of the winnings exceeds the set distribution limit, the machine gets locked and triggers the transmission of a signal to the games room staff. A staff member then goes and draws up a payment voucher (BP) that the customer can use to get his or winnings paid at the cash desk, and resets the CREDIT counter on zero by using a key known as a CANCEL KEY. This operation leads to the CANCEL CREDIT (CC) counter being incremented by the number of tokens payed.

When a player wins the jackpot, the machine stops immediately. The amount of this jackpot is far beyond the the automatic redistribution limit of the feeder box, and the signal to the staff member is sent in this case too. A staff member then, in the same way as above, draws up a payment voucher (BP), gives it to the customer, and then resets the CREDIT counter on zero by using the CANCEL KEY. The JACKPOT counter (JK) is then automatically incremented by the number of tokens paid, divided by 10. This division corresponds to the fact that the jackpot is always a multiple of 10, making it possible to have a counter that is smaller than necessary to record the exact sum corresponding to the jackpot.

A French regulation stipulates that the contents of the JACKPOT counter should be compared with the payments actually made on the basis of the payment vouchers BP drawn up by the staff. There is always a difference corresponding to winnings not claimed by customers for different reasons. This difference has to be given to charity. This point raises a problem in France, as shall be seen further below, in enabling the use of card validation systems owing to the merger of the JACKPOT and CANCEL CREDIT counters referred to further above.

In a gaming machine, the main check is on the number of tokens contained in the feeder box. The variation Vt of this number is computed by means of the following formula:

$$Vt=TI-CB-TO+BA \quad (1)$$

The income PG from the machine is itself computed by means of the formula:

$$PG=TI-TO-BP(JK, CC)=CB-BA-BP(JK, CC) \quad (2)$$

As explained further above, the variation of the contents of the feeder box is an essential element for checking the operation of the gaming machine. The use of a card-operated payment mechanism in a machine that has a token-operated payment mechanism and is capable of combined operation should not in any way disturb the working of the counters TI and TO which play a role in the computation of this variation. This therefore in principle rules out any mixing between the inputs of virtual tokens (electronic pulses) from the card-operated payment mechanisms and the inputs of real tokens from the token-operated payment mechanism, as well as the use of the feeder box control signals to pay out winnings in the card.

The token-operated payment mechanisms are also called COMPARITORS.

SUMMARY OF THE INVENTION

To overcome these difficulties, the invention proposes a games machine with mechanical counters as laid down by the regulations and an electronic payment mechanism in which a certain number of links of wager-placing units and pay-out control units of the machine are diverted by means of the electronic payment mechanism to enable wagers to be placed and winnings to be paid out by means of the chip card, without receiving or delivering tokens and preferably without modifying the contents of the TOTAL IN counter (101) and the TOTAL OUT counter (102).

Another approach to these problems consists in modifying the contents of these counters, and the balance of the feeder box containing the coins is obtained by modifying the formula of computing this balance.

The machine notably has a CANCEL CREDIT type of counter, a CASH OUT type of button and a CANCEL KEY type of key. Thus, according to the invention, the electronic payment mechanism is interposed on the paths of the connections of the button and the key and the connection between the games machine and said CANCEL CREDIT counter is connected to an input of the electronic payment mechanism to make it possible, when this contains a valid chip card, to divert the action of the button of the machine towards the electronic payment mechanism, simulate the action of the key and count the control signals of the CANCEL CREDIT counter in order to enable the winnings to be paid out on the card without the issuing of tokens.

According to another characteristic, this machine furthermore includes a CREDIT type counter and an input for a banknote-operated payment mechanism connected to this CREDIT counter, and an output of the electronic payment mechanism is connected to an input of the banknote-operated payment mechanism to enable a wager to be placed through payments on the chip card.

According to another characteristic, this machine furthermore includes a TOTAL IN type counter, and an output of the electronic payment mechanism is connected to this TOTAL IN counter to enable a wager to be placed through payments on the chip card.

According to another characteristic, this machine furthermore includes a TOTAL OUT type counter connected to a token output, the button and the key are connected directly to the machine and the link between the TOTAL OUT counter and the box is diverted towards the electronic payment mechanism to enable the paying out of winnings on the card without any issuing of tokens.

BRIEF DESCRIPTION OF THE DRAWINGS

Other particular features and advantages of the invention shall appear clearly from the following description, given by way of a non-restrictive example and made with reference to the appended figures, of which.

MORE DETAILED DESCRIPTION

The simplest and most elegant solution by which it is possible to use the gaming machine with a system based on a chip card reader system, for example with a reader of the type described in the above-mentioned patent application which may be referred to for more details, definitely consists in connecting this reader to the electronic management circuit of the gaming machine, for example by means of an RS232 type link.

Indeed, the electronic control systems of the gaming machines are now all built around a microprocessor-based computer system such as a PC or personal computer. The mechanical counters described here above remain of course mechanical so that they cannot be reset at zero by simple software action, but their contents are nevertheless picked up by sensors and stored in memories of the computer control system. Under these conditions, it is relatively easy to simulate the arrival and outgoing of coins by the transmission, in both directions, of credit taken from or recorded in chip cards while keeping the rules of operation of the machine intact, especially those relating to the incrementation of the counters and the different locking operations as a function of the winnings obtained.

The drawback of this method lies in the fact that it is necessary to get the manufacturers to modify the operating software of the existing machines and of the machines that will manufactured in the future, when a chip card reader has to be grafted on to them (this reader being, for example, the reader described in the patent application referred to in the introduction and commercially distributed by the present Applicant under the reference GCV200).

Such a modification is, of course, costly, especially in view of the procedures of validation of these programmes which have to be particularly strict. The use of this approach would therefore be entirely at the discretion of the manufacturers of gaming machines, and even if some of them agree to it, so long as one or more manufacturers representing a significant part of the market do not accept it, it will be necessary to find an essentially physical approach.

Figure 1:
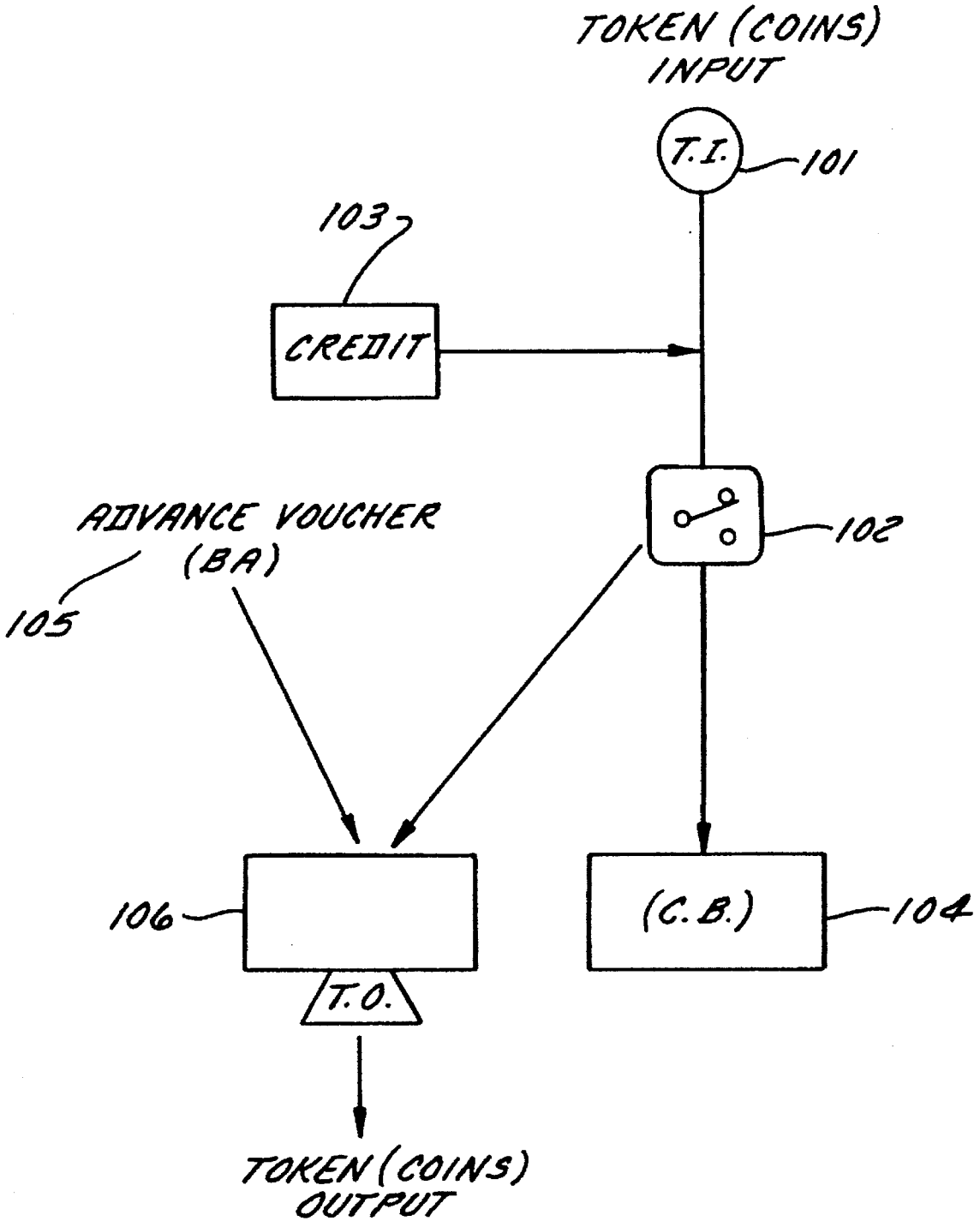
FIG. 1 shows a diagram of the flow of the tokens in an ordinary gaming machine.
Figure 2:
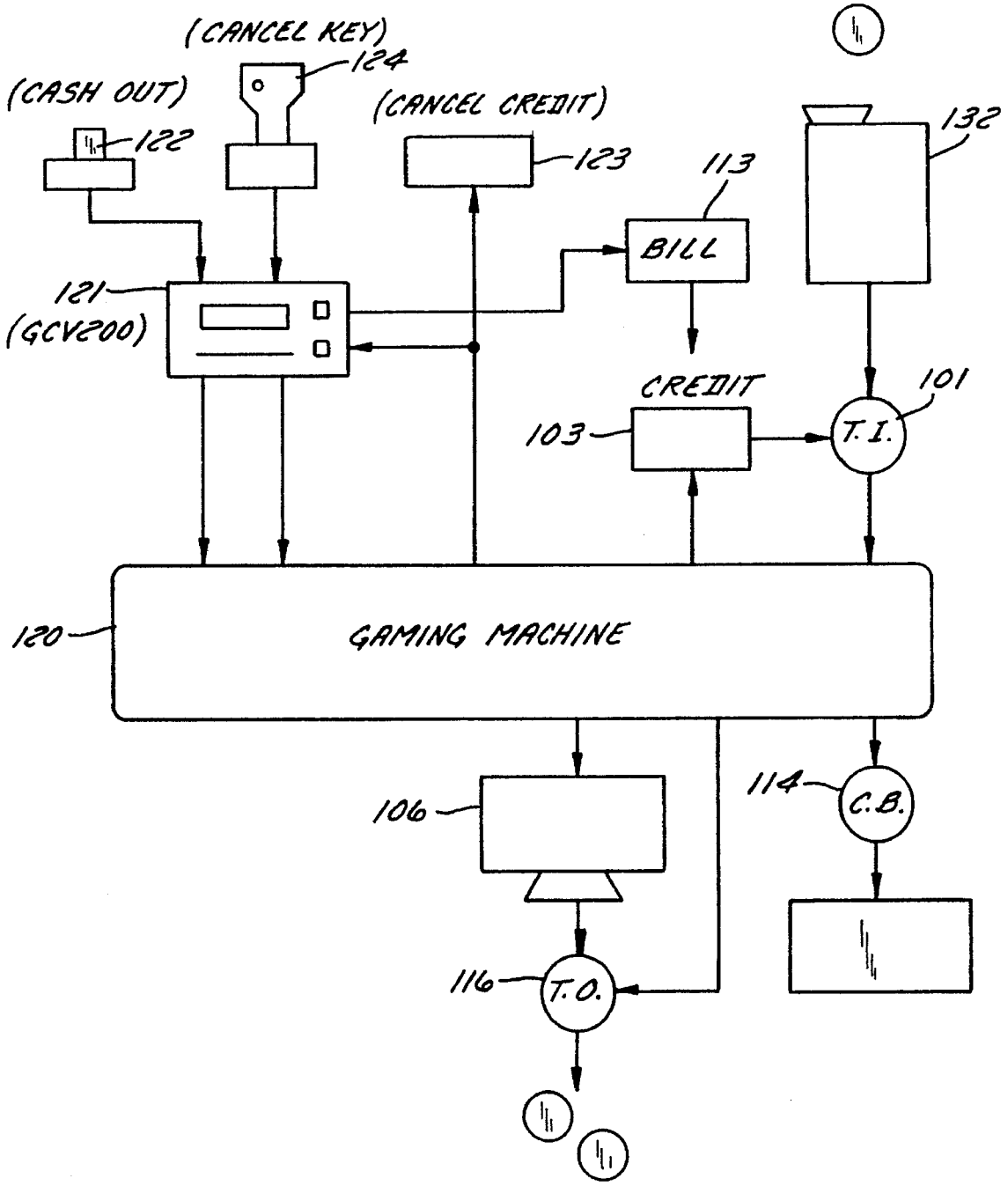
FIG. 2 shows a connection, according to the invention, between a chip card operated payment mechanism and a gaming machine.

A first approach, shown schematically in FIG. 2, essentially consists in connecting the chip card payment mechanism 121 (GCV200) to the banknote-operated payment mechanism 113 that is generally present in machines and enables payment with banknotes in addition to credit tokens. This payment mechanism causes the CREDIT counter 103 to be incremented by means of an electrical link to which it is easy to connect the payment mechanism 121 (GCV200) which is programmed to send the signals compatible with those corresponding to the banknotes introduced into the payment mechanism 113.

With regard to the paying out of the winnings, the approach used, for example, will be the one implementing the CASH OUT button 122 and the CANCEL KEY 123. These units will then be connected to the gaming machine 120 no longer directly but by means of the GCV200. When no card is inserted into the GCV200, or when this reader does not recognize the card introduced, the signals of this button and this key are transmitted directly to the gaming machine, and it then works in the ordinary way.

However, when the GCV200 recognizes a valid card, action on the CASH OUT 122 button is diverted towards the GCV200 and does not reach the gaming machine. This can be done, for example, by means of an opto-coupler which receives the information from the button 122 and a relay which cuts off the link with the gaming machine.

Under the effect of this action, the GCV200 simulates the action of the CANCEL KEY 124, for example by means of a relay that closes. There is thus obtained the same effect as in the case of a paying out of totalized small gains exceeding the automatic redistribution limit, even if this total is below this limit. The value is that the TOTAL OUT counter 116 is then no longer activated. This does not falsify the results of the computation of the contents of the feeder box 106.

The gaming machine then resets the CREDIT counter 103 at zero and increments the CANCEL CREDIT counter 123 by the number of tokens won. The link between the gaming machine and this counter 123 is also connected to the GCV200, which enables it to count out the pulses reaching the counter 123 and, on the basis of these information elements, to recharge the chip card contained in the GCV200 with a credit corresponding to the winnings obtained.

The fact that the CANCEL CREDIT 123 is incremented by winnings smaller than the limit of payment of the accumulated small winnings and that, furthermore, the player can have these winnings paid directly into his card, absolutely corresponds to the desired aim of having the capacity to enable the player to play more quickly and for a longer period of time without interruption since there is then no longer any need to approach staff members.

However, it is possible here to note the appearance of the drawbacks referred to further above relating to French law according to which the JACKPOT and CANCEL CREDIT counters are merged into a single JACKPOT counter.

Indeed, while it is always possible to provide for blocking the procedure of automatic payment into the chip card when the player has won the jackpot and then having payment made to him through the issue of a payment voucher by an operator, the contents of the single counter JACKPOT will correspond to the sum of the jackpots that are the object firstly of a payment voucher and, secondly, of the small winnings that are directly paid into the card. Hence, when the contents of the JACKPOT counter are compared with the sums actually paid out on presentation of the payment vouchers, the difference will have to be paid to a charitable organization as stipulated by the law. Now, this difference will correspond to the sum of the payment vouchers for which no payment has been made and the credits directly recorded in the chip cards in circulation, which should remain available to the player since this is one of the principal valuable features of the system. The proprietor of the gaming machine will therefore have to pay out sums greater than are owed by him: this will be a dead loss for him.

It would be possible, in machines used in France, to reinstall the CANCEL CREDIT mechanical counter since these machines are all manufactured in countries where the counter is obligatory. The counter is simply not installed on machines designed to be delivered in France. This approach, however, is difficult to implement systematically.

The simplest approach then would be to provide for a electronic CANCEL CREDIT counter in the GCV200 enabling a distinction to be made between the winnings made through the jackpot and the small winnings paid out on the cards.

In certain fairly rare cases, corresponding to machines that are relatively old or possibly simplified for reasons of cost, there is no banknote-operated payment mechanism. In this case, there is therefore no input on the CREDIT counter 113 enabling it to be incremented.

Figure 3:
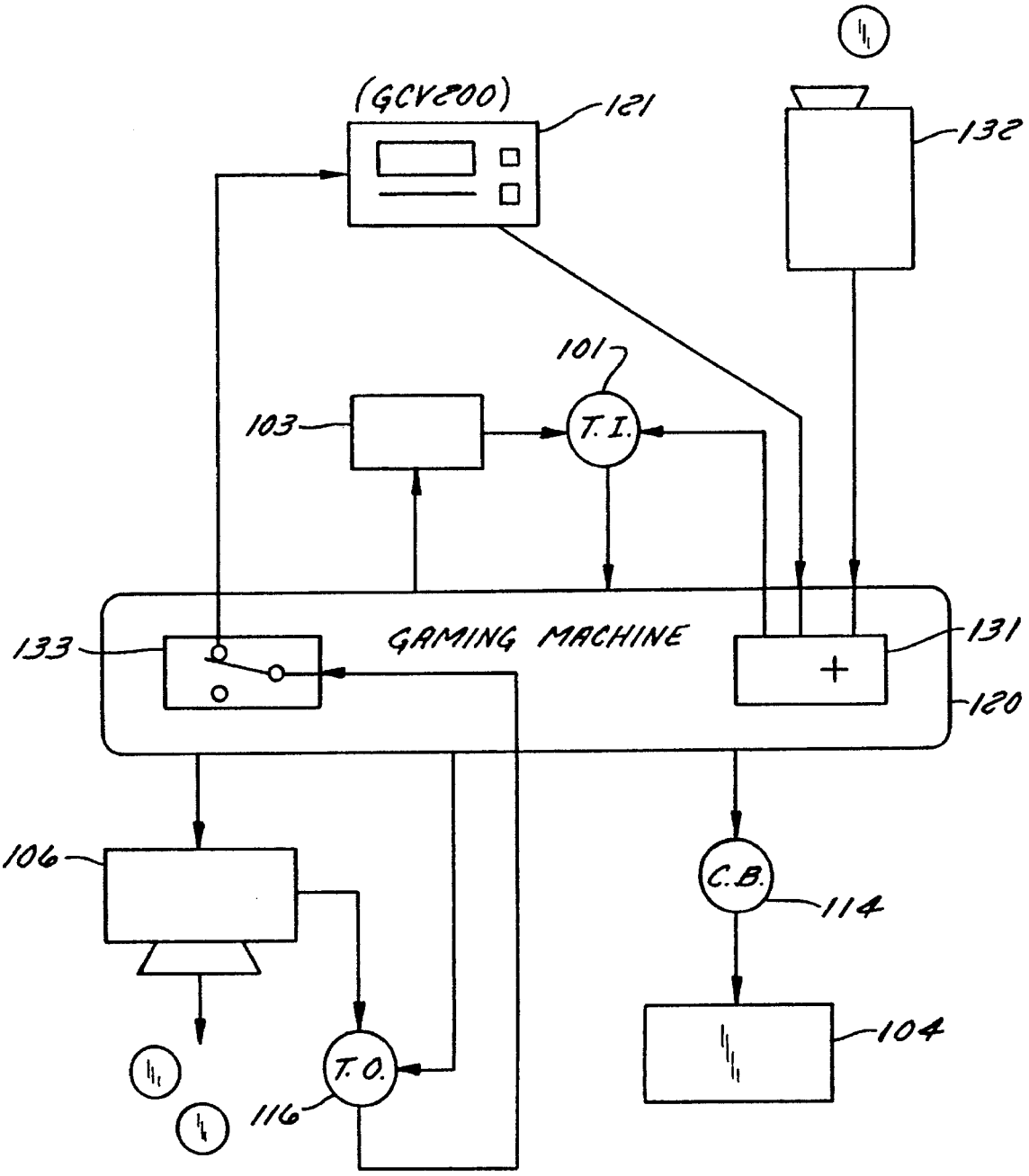
FIG. 3 shows a variant of the system of FIG. 2.

To then enable the use, all the same, of a GCV200, the invention proposes the use of a structure such as the one shown in FIG. 3, in which the GCV200 121 is connected to the TOTAL IN counter 101 by means of a circuit 131 that brings together the signals coming from the coin-operated payment mechanism and from the GCV200. These signals therefore send the machine the number of credits coming from the GVC200 when this reader is used, but this action is done by means of the counter 101, which is credited with the same amount. The return of the winnings in the GCV200 can then furthermore be done in two ways:

by managing the signal of the CASH OUT button, the CANCEL KEY and the CANCEL CREDIT counter, not shown in FIG. 3, as described in the above approach, by using the signals addressed by the gaming machine to the feeder box to inform the GCV200 of the amount of credit to be recorded in the chip card. A relay 133 will then make it possible to deflect the signals that come from the gaming machine and are normally designed for the feeder box 106, to apply them to the GCV200.

Since it is important, as we have already seen, to be able to control the variation of the contents of the feeder box, the system will use two electronic counters, TIcard and a TOcard, located in the payment mechanism 121 (GCV200). The indications from the counters will then be inserted into the VT computation formula which will become:

$$Vt=TI-TIcard-CB-TO+TOcard+BA \quad (3)$$

Finally, when a secured token-based payment mechanism as described in the above-mentioned patent is used, it is possible of course to connect the GCV200 to the gaming machine of the above-described system.

However, in this case, it is worthwhile to connect the GCV200 to the secured token-based payment mechanism to enable the provision, to this payment mechanism from the GCV200, of a black list of tokens or of sets of tokens prohibited for reasons explained in the patent application referred to. This black list will advantageously be memorized in the GCV200 on the basis of a specialized chip card which is itself charged by external means for collecting the numbers of the blacklisted cards.

Furthermore, this link will also make it possible to recover the contents of the counter of authenticated tokens which is designed in the secured token payment mechanism.

Figure 4:
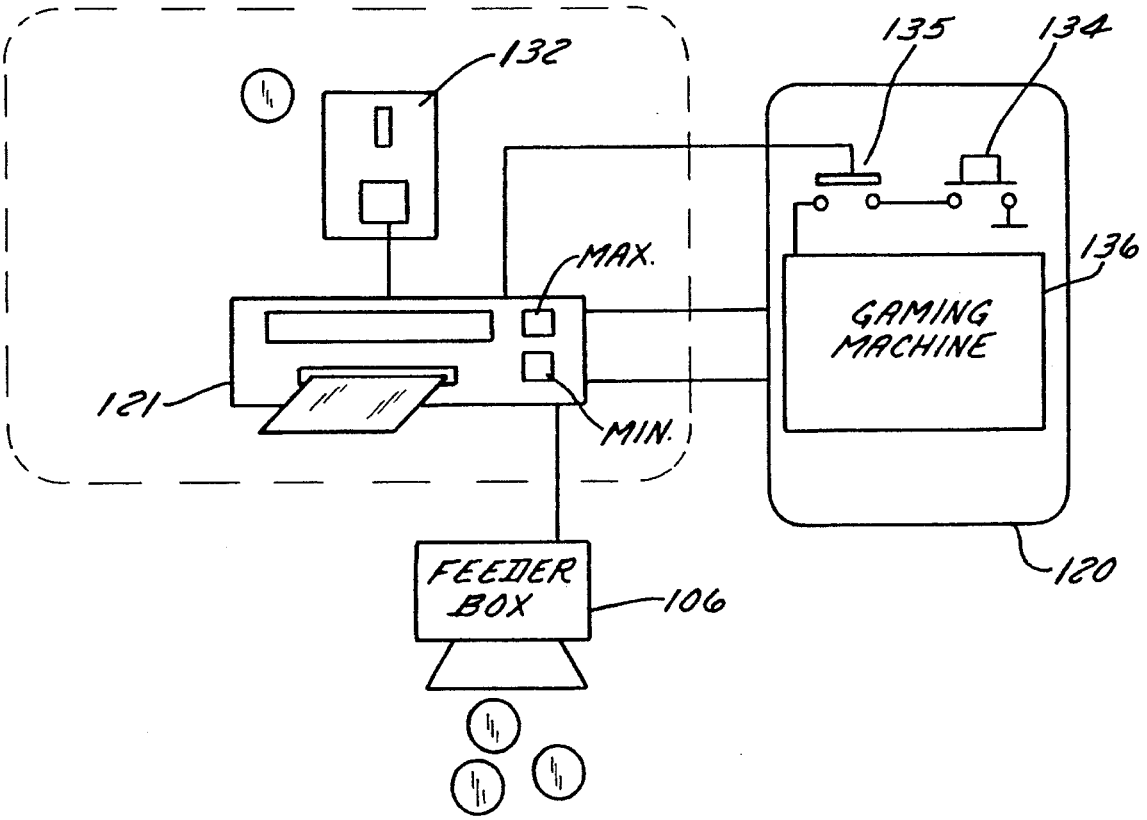
FIG. 4 shows a detailed embodiment.

Another object of the present invention is to prevent the player from starting a game before all the tokens have been staked in the gaming machine in the event of a maximum wager. For the rest of the description, reference may be made to the drawing of FIG. 4. Indeed, on gaming machines, for example video poker machines or roller machines, the player must stake a certain number of tokens before starting a game in the hope of winning. The more tokens staked by the player, the more he or she will win in the event of a winning combination.

In these gaming machines, there is a maximum number of tokens that the player can stake, for example 3, 5 or 10 tokens depending on the machines. To be capable of winning the jackpot, the player must absolutely stake the maximum number of tokens corresponding to the machine on which he is playing. The following is the sequence:

the player inserts the maximum number of tokens one after the other;

then, he or she presses the button 134 to start a game on the gaming machine 120. On certain machines, the game is started automatically when the number of tokens staked corresponds to the maximum number of tokens accepted by the machine.

In the card-operated payment mechanism 121, there is a key MAX that enables the maximum number of tokens to be issued quickly. However, if the player presses the button 134 for starting the game on the gaming machine before the user has staked all the tokens, then the payment table used by the machine to pay out returns on the winning configurations will correspond to the number of tokens staked when the game-starting button is pressed and not to the maximum number of tokens. Consequently, even in the event of a maximum winning configuration, it will be impossible for the player to win the jackpot.

To resolve this problem, the system prohibits the possibility, if the MAX key of the payment mechanism 121 should be pressed, of starting a game before all the tokens have been staked in the gaming machine, this prohibition being applied by means of a locking circuit (for example a relay 135) placed on the action control wire of the button 134 connected to the standard interface 136 of the gaming machine. The relay is activated by the payment mechanism 121 when the player presses the MAX key. The payment mechanism then activates the blocking relay of the game-starting button 134. The payment mechanism issues the maximum number of tokens corresponding to the gaming machine. The payment mechanism reactivates the relay 135 for locking the game-starting button, and the player can then start the game by using the button 134.

What is claimed is:

1. A payment system for a games machine required by law to have mechanical counters, the games machine payment system comprising:

the mechanical counters required by law, the mechanical counters being connected to the games machine, pay-out control units for controlling the paying out of winnings to a player of the games machine, the pay-out control units being connected to the games machine, wager-placing units which permit the player to place a wager with credits, the wager-placing units being connected to the games machine, an electronic payment mechanism, the electronic payment mechanism being connected to the games machine, and the electronic payment mechanism having an input and an output.

wherein, when the electronic payment mechanism contains a valid chip card, the input receives a pay-out control signal from the pay-out control units, the output transmits a payment signal which simulates a signal transmitted by one of a coin-operated payment mechanism and a banknote-operated payment mechanism, and the electronic payment mechanism enables the placing of wagers and the paying out of winnings through the chip card without receiving or delivering tokens.

2. A games machine payment system according to claim 1, wherein the pay-out control units include a credit cancellation counter CANCEL CREDIT which counts payments to the player in the form of payment vouchers, a cash outlet button CASH OUT for the player to press to have winnings paid out, and a cancellation key CANCEL KEY for resetting a credit counter CREDIT, the credit counter CREDIT being one of the wager placing units, and wherein the electronic payment mechanism is interposed on the connection paths from the cash outlet button and the cancellation key to the games machine, and wherein an output of the games machine is connected to the credit cancellation counter and to the electronic payment mechanism.

3. A games machine payment system according to claim 1, wherein the wager-placing units include a credit counter CREDIT for counting the player's unpayed winnings, and a credit counter input for connecting a banknote-operated payment mechanism to the credit counter, and wherein the output of the electronic payment mechanism is connected to an input of the banknote-operated payment mechanism to enable a wager to be placed on the basis of payments made on the chip card.

4. A games machine payment system according to claim 1 further comprising:

a counter of total inputs TOTAL IN for counting the number of tokens that are physically inserted into the games machine, and wherein the output of the electronic payment mechanism is connected to the counter of total inputs to enable a wager to be placed on the basis of payment made on the chip card.

5. A games machine payment system according to claim 4, further comprising:

a counter of total outputs TOTAL OUT connected to a token output box, the counter of total outputs being connected to the games machine and counting the number of tokens that are physically discharged from games machine, the token output box being connected to the games machine and being adapted for discharging tokens from the games machine, and wherein the pay-out control unit include a cash outlet button for the player to press to have winnings paid out and a cancellation key for resetting a credit counter, the credit counter being one of the wager placing units, wherein the cash outlet button and the cancellation key are directly connected to the games machine such that the electronic payment mechanism input receives the pay-out control signal via the games machine, and wherein an output of the games machine is selectively coupled to an input of the token output box and the input of the electronic payment mechanism, the games machine output being coupled exclusively to the input of the electronic payment mechanism when the electronic mechanism contains the valid chip card to enable the paying out of winnings into the card without issuing tokens.

6. A games machine payment system according to claim 1, wherein the games machine further comprises a feeder box, the feeder box containing a sufficient number of tokens to pay out winnings by discharging tokens to the player, and wherein the electronic payment mechanism comprises an electronic counter TIcard and an electronic counter TOcard, the electronic counters TIcard and TOcard cooperating to check variations of the contents of the feeder box.

7. A games machine payment system according to claim 1, further comprising a device to lock a game-starting button of the games machine in the case of a maximum wager by a maximum wager button of the payment mechanism.

8. A games machine having the games machine payment mechanism of claim 1.

9. A method of operating a payment mechanism of a games machine to ensure compliance with a law, the method comprising the steps of:

providing a plurality of mechanical counters for counting tokens received into the games machine and delivered by the games machine, the plurality of mechanical counters being required by the law;

accepting non-chip card payment, the step of accepting non-chip card payment being performed by one of a coin-operated payment mechanism and a banknote operated payment mechanism;

accepting chip card payment, the chip card payment accepting step comprising the steps of providing the games machine with an electronic payment mechanism, and transmitting a payment acceptance signal from the electronic payment mechanism to one of the games machine, a wager-placing unit and a counter of total inputs, the payment acceptance signal simulating a signal transmitted by one of the coin-operated payment mechanism and the banknote operated payment mechanism;

paying out winnings with tokens, the paying out step comprising the step of transmitting a payout signal to a token output box;

paying out winnings by way of the chip card, the chip card paying out step comprising the step of transmitting the payout signal to the electronic payment mechanism instead of to the token output box;

and wherein, during operation of the games machine, both tokens and chip cards can be used without affecting the counting of tokens received or delivered.

10. A method of operating a payment mechanism according to claim 9, wherein the step of transmitting a payment acceptance signal comprises transmitting the payment acceptance signal from the electronic payment mechanism to a credit counter.

11. A method of operating a payment mechanism according to claim 9, wherein the chip card paying out step further comprises the steps of:

connecting a credit cancellation key to the games machine via the electronic payment mechanism;

connecting a cash outlet button to the games machine via the electronic payment mechanism;

recognizing that the cash outlet button has been pressed by the player, the pressing of the cash outlet button indicating that the player wishes to have winnings paid out;

recharging the chip card with a value corresponding to the amount of winnings;

sending the payout control signal from the cash outlet button, to the electronic payment mechanism, then to the games machine, and then to a credit cancellation counter and a credit counter, the credit cancellation counter counting payments to the player in the form of vouchers, and the credit counter being indicative of the number of credits available to the player for wagering;

and, in response to the payout signal, incrementing the credit cancellation counter by the amount of winnings obtained and resetting the credit counter.

12. A method of operating a payment mechanism according to claim 9, wherein the step of transmitting a payment acceptance signal comprises transmitting the payment acceptance signal from the electronic payment mechanism to the games machine, and then transmitting the payment acceptance signal from the games machine to the counter of total inputs.

13. A method of operating a payment mechanism according to claim 9, wherein the chip card paying out step further comprises the steps of:

connecting a credit cancellation key to the games machine;

connecting a cash outlet button to the games machine;

recognizing that the cash outlet button has been pressed by the player, the pressing of the cash outlet button indicating that the player wishes to have winnings paid out;

sending the payout signal from the cash outlet button to the games machine, then to the electronic payment mechanism, a credit cancellation counter, and a credit counter, the credit cancellation counter counting payments to the player in the form of vouchers, and the credit counter being indicative of the number of credits available to the player for wagering;

and, in response to the payout signal, recharging the chip card with a value corresponding to the amount of winnings obtained, incrementing the credit cancellation counter by the amount of winnings obtained, and resetting a credit counter.

14. A method of operating a payment mechanism according to claim 9, further comprising the step of providing a cancel credit counter in the electronic payment mechanism which distinguishes between winnings paid through vouchers and winnings paid out on the chip card.

15. A method of operating a payment mechanism according to claim 9, further comprising the step of locking a game-starting button of the games machine, the locking step being performed in the event of a maximum wager button of the payment mechanism to ensure that all payment is received prior to the initiation of a game.

16. A games machine that implements the method according to claim 9.

17. A payment mechanism for a games machine required by law to have mechanical counters, the games machine comprising a token reception mechanism, the token reception mechanism being connected to the games machine, and the token reception mechanism being adapted for receiving tokens into the games machine;

a token discharge mechanism, the token discharge mechanism being connected to token reception mechanism, and the token discharge mechanism being adapted for discharging tokens from the games machine;

an electronic payment mechanism, the electronic payment mechanism being connected to the games machine, and the electronic payment mechanism being adapted for receiving payment from a chip card and for paying out winnings into the chip card;

a first counter, the first counter being connected to the games machine, the first counter counting the total number of tokens which have been inserted into the games machine via the token reception mechanism, and the first counter treating chip card payment as if it were in the form of tokens received from the token reception mechanism;

a second counter, the second counter being connected to the games machine, the first counter counting the total number of tokens which have been discharged into the games machine, and the second counter treating the paying out of winnings into the chip card as if it were in the form of tokens discharged by the token discharge mechanism;

a credit counter, the credit counter being connected to the games machine, and the credit counter being indicative of a number of credits available to the player for wagering;

a credit cancellation counter, the credit cancellation counter being connected to the games machine, and the credit cancellation counter counting payments to the player in the form of payment vouchers;

a cash outlet button, the cash outlet button being connected to the games machine, and the cash outlet button permitting the player to communicate to the payment system that he wishes to have his winnings paid out; and a cancellation key, the cancellation key being connected to the games machine, and the cancellation key being adapted for resetting the credit counter;

and wherein, during the operation of the games machine, the electronic payment mechanism, the credit counter, the credit cancellation counter, the cash outlet button, and the cancellation key cooperate such that both tokens and chip cards can be used without affecting the counting of tokens received or discharged.

18. A payment mechanism according to claim 17, wherein the electronic payment mechanism is interposed on the paths of the connections of the cash outlet button and the cancellation key to the games machine, and wherein an output of the games machine is connected to the credit cancellation counter and to the electronic payment mechanism.

19. A payment mechanism according to claim 17, wherein the second counter is connected to a token output box, the token output box being connected to the games machine and being adapted for discharging tokens from the games machine, wherein the cash outlet button and the cancellation key are directly connected to the machine, and wherein an output of the games machine is selectively coupled to an input of the token output box and the input of the electronic payment mechanism, the games machine output being coupled exclusively to the input of the electronic payment mechanism when the electronic mechanism contains the valid chip card to enable the paying out of winnings into the card without issuing tokens.

20. A payment system according to claim 17, further comprising a device to lock a game-starting button of the games machine in the case of a maximum wager by a maximum wager button of the payment mechanism.

* * * * *